US011503408B2

(12) United States Patent
Yamamoto

(10) Patent No.: US 11,503,408 B2
(45) Date of Patent: Nov. 15, 2022

(54) SOUND BAR, AUDIO SIGNAL PROCESSING METHOD, AND PROGRAM

(71) Applicant: Sony Group Corporation, Tokyo (JP)

(72) Inventor: Yusuke Yamamoto, Kanagawa (JP)

(73) Assignee: Sony Group Corporation, Tokyo (JP)

( * ) Notice: Subject to any disclaimer, the term of this patent is extended or adjusted under 35 U.S.C. 154(b) by 0 days.

(21) Appl. No.: 17/420,368

(22) PCT Filed: Nov. 14, 2019

(86) PCT No.: PCT/JP2019/044688

§ 371 (c)(1),
(2) Date: Jul. 1, 2021

(87) PCT Pub. No.: WO2020/144937

PCT Pub. Date: Jul. 16, 2020

(65) Prior Publication Data

US 2022/0095051 A1 Mar. 24, 2022

(30) Foreign Application Priority Data

Jan. 11, 2019 (JP) ..... JP2019-003024

(51) Int. Cl.

| | |
|---|---|
| ***H04R 5/02*** | (2006.01) |
| ***H04R 1/32*** | (2006.01) |
| ***H04R 1/34*** | (2006.01) |
| ***H04R 3/12*** | (2006.01) |

(52) U.S. Cl.

CPC ..... *H04R 5/02* (2013.01); *H04R 1/323* (2013.01); *H04R 1/347* (2013.01); *H04R 3/12* (2013.01); *H04R 2201/021* (2013.01); *H04R 2205/024* (2013.01)

(58) Field of Classification Search

CPC ..... H04R 5/02; H04R 1/323; H04R 1/347; H04R 3/12; H04R 2201/021; H04R 2205/024; H04R 2201/40; H04R 2201/401; H04R 2201/403; H04R 2201/405; H04S 7/302; H04S 7/303; H04S 2420/01

See application file for complete search history.

(56) References Cited

U.S. PATENT DOCUMENTS

| | | | | |
|---|---|---|---|---|
| 6,643,377 | B1 | 11/2003 | Takahashi et al. | |
| 2006/0251271 | A1 | 11/2006 | Grimani | |
| 2008/0226084 | A1 * | 9/2008 | Konagai ..... | H04R 25/45 381/17 |

(Continued)

FOREIGN PATENT DOCUMENTS

| | | | |
|---|---|---|---|
| CN | 107888857 | A | 4/2018 |
| JP | 2000-023281 | A | 1/2000 |

(Continued)

OTHER PUBLICATIONS

International Search Report and English translation thereof dated Feb. 4, 2020 in connection with International Application No. PCT/JP2019/044688.

*Primary Examiner* — Jason R Kurr
(74) *Attorney, Agent, or Firm* — Wolf, Greenfield & Sacks, P.C.

(57) ABSTRACT

Provided is a sound bar including: a rear sound signal generating unit that generates a rear sound from an input audio signal; and an output unit that outputs the rear sound generated by the rear sound signal generating unit to a rear sound speaker.

12 Claims, 12 Drawing Sheets

(56) References Cited

U.S. PATENT DOCUMENTS

| | | | | |
|---|---|---|---|---|
| 2012/0070021 | A1 | 3/2012 | Yoo et al. | |
| 2013/0121515 | A1* | 5/2013 | Hooley | H04S 7/303 381/300 |
| 2014/0126753 | A1* | 5/2014 | Takumai | H04S 7/305 381/303 |
| 2015/0356975 | A1 | 12/2015 | Seo et al. | |
| 2018/0098175 | A1 | 4/2018 | Buerger et al. | |
| 2018/0184202 | A1* | 6/2018 | Walther | H04R 1/345 |
| 2018/0317003 | A1* | 11/2018 | Chang | H04R 1/403 |
| 2019/0116445 | A1* | 4/2019 | Gerrard | H04S 7/302 |

FOREIGN PATENT DOCUMENTS

| | | | |
|---|---|---|---|
| JP | 2004-007039 | A | 1/2004 |
| JP | 2008-011253 | A | 1/2008 |
| JP | 2010-124078 | A | 6/2010 |
| JP | 2011-124974 | A | 6/2011 |
| JP | 2017-169098 | A | 9/2017 |
| JP | 2018-527808 | A | 9/2018 |

* cited by examiner

SOUND BAR, AUDIO SIGNAL PROCESSING METHOD, AND PROGRAM

CROSS-REFERENCE TO RELATED APPLICATIONS

This application claims the benefit under 35 U.S.C. § 371 as a U.S. National Stage Entry of International Application No. PCT/JP2019/044688, filed in the Japanese Patent Office as a Receiving Office on Nov. 14, 2019, which claims priority to Japanese Patent Application Number JP2019-003024, filed in the Japanese Patent Office on Jan. 11, 2019, each of which is hereby incorporated by reference in its entirety.

TECHNICAL FIELD

The present disclosure relates to a sound bar, an audio signal processing method, and a program.

BACKGROUND ART

Conventionally, there is known a sound bar that is disposed on a lower side of a television apparatus and is that reproduces the sound or the like of television broadcasting.

CITATION LIST

Patent Literature

Patent Literature 1: Japanese Patent Application Laid-open No. 2017-169098

DISCLOSURE OF INVENTION

Technical Problem

However, since a general sound bar is disposed on the television apparatus side, i.e., in front of a viewer, there is a problem that the wiring connected to the television apparatus or the sound bar can be seen from the viewer and it gives not good impression or the like.

It is one of objects of the present disclosure to provide a sound bar that is disposed behind a viewer and reproduces a rear sound, an audio signal processing method, and a program.

Solution to Problem

The present disclosure is, for example, a sound bar including:

a rear sound signal generating unit that generates a rear sound from an input audio signal; and an output unit that outputs the rear sound generated by the rear sound signal generating unit to a rear sound speaker.

Moreover, the present disclosure is, for example, an audio signal processing method in a sound bar, including:

generating, by a rear sound signal generating unit, a rear sound from an input audio signal; and outputting, by an output unit, the rear sound generated by the rear sound signal generating unit to a rear sound speaker.

Moreover, the present disclosure is, for example, a program that causes a computer to perform an audio signal processing method in a sound bar:

generating, by a rear sound signal generating unit, a rear sound from an input audio signal; and outputting, by an output unit, the rear sound generated by the rear sound signal generating unit to a rear sound speaker.

MODE(S) FOR CARRYING OUT THE INVENTION

Embodiments and the like of the present disclosure will now be described below with reference to the drawings. It should be noted that descriptions will be given in the following order.

<Problems to be Considered>

<Embodiment>

<Modified Examples>

The embodiment and the like described below are favorable specific examples of the present disclosure and the details of the present disclosure are not limited to the embodiment and the like.

Problems to be Considered

Figure 1:
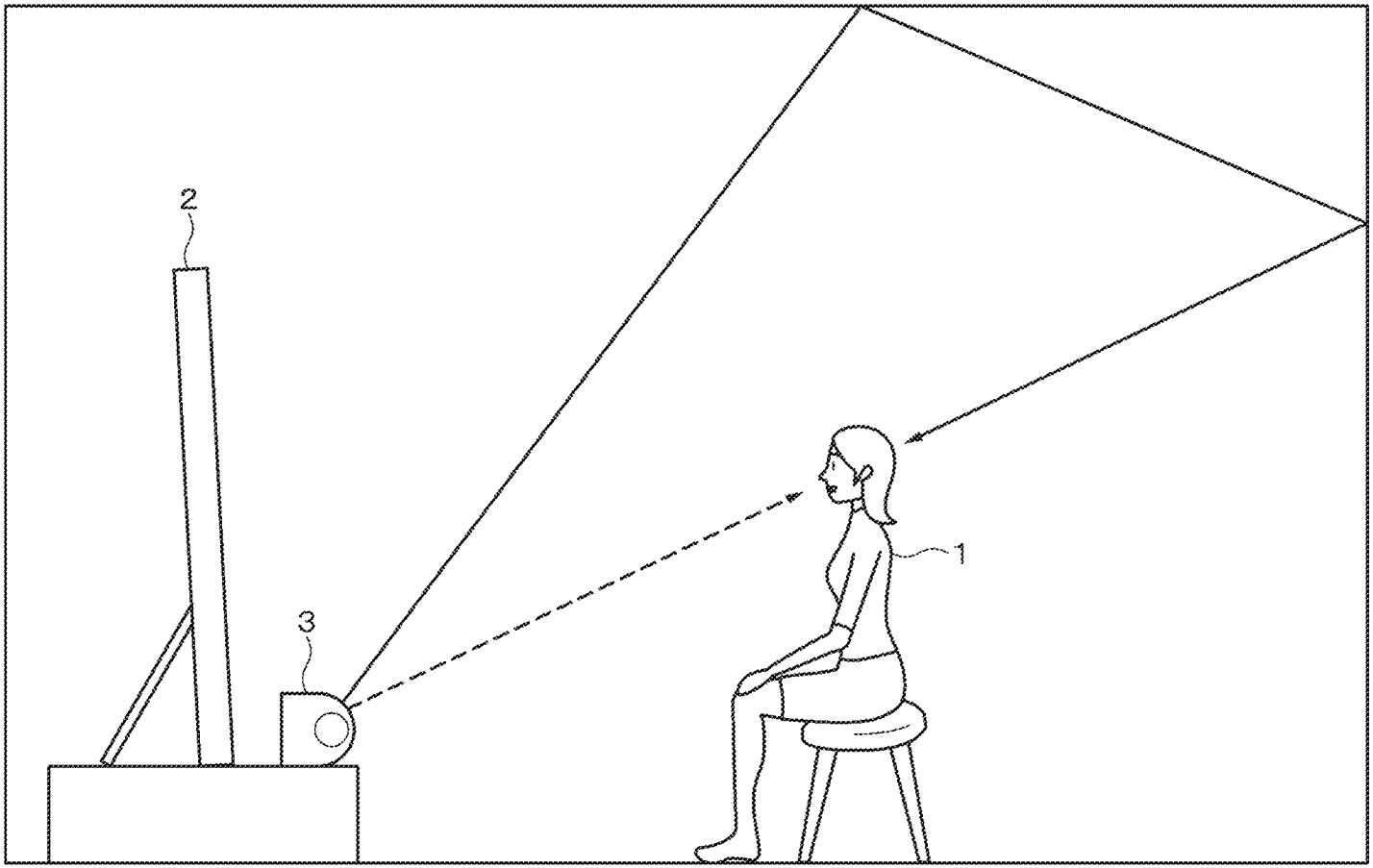
FIG. 1 is a diagram for describing problems to be considered in an embodiment.

First, problems to be considered in this embodiment will be described. FIG. 1 shows a general reproduction system using a sound bar. As shown in FIG. 1, a television apparatus 2 and a sound bar 3 are set in front of a viewer 1. The viewer 1 views a video reproduced by the television apparatus 2 and a sound reproduced by the sound bar 3. The sound reproduced by the sound bar 3 is subjected to sound image localization by radiation processing (beam processing) in a particular direction, processing based on head-related transfer functions (HRTF), or the like, reaches the viewer 1, and is heard by the viewer 1 as schematically shown by the solid line or dotted line arrows.

In the general reproduction system shown in FIG. 1, there is a possibility that the periphery of the television apparatus 2 is unorganized due to devices and wiring such as the sound bar 3 and the design of the television apparatus 2 does not match the arrangement form of the periphery. There is also a possibility that the sound image is blurred without clear positional relationship between the viewer 1 and the television apparatus 2. Moreover, since an actual speaker is not disposed behind (in the rear of) the viewer 1, it may be difficult to exactly express a rear sound field. Moreover, in recent years, a television apparatus 2 provided with a camera and capable of imaging a viewer 1 has also been proposed. Since the viewer 1 knows that the television apparatus 2 is provided with the camera, there is a possibility that the viewer 1 feels stress by thinking that the viewer 1 may be imaged. While considering the above points, the embodiment of the present disclosure will be described in detail.

EMBODIMENT

Configuration Example of Reproduction System

Figure 2:
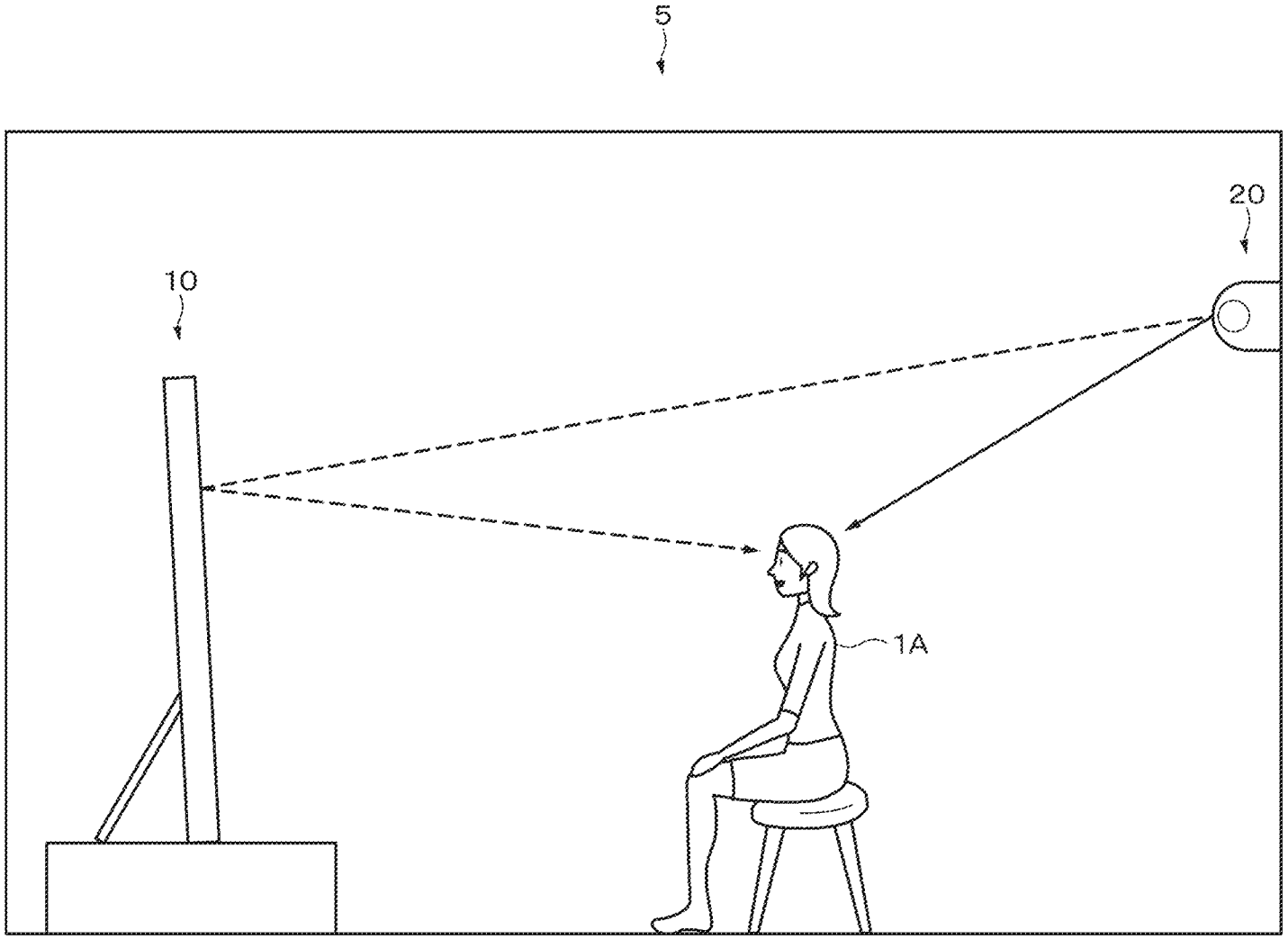
FIG. 2 is a diagram showing a configuration example of a reproduction system according to the embodiment.

FIG. 2 is a diagram showing a configuration example of a reproduction system (reproduction system 5) according to the embodiment. In front of a viewer 1A, a television apparatus (hereinafter, television apparatus will be sometimes abbreviated as TV) 10 is disposed, and the viewer 1A views the video of the television apparatus 10. Moreover, a sound bar 20 is set behind the viewer 1A, more specifically, in a vertical direction at the rear. The sound bar 20 is supported on the wall or ceiling by an appropriate method, for example, with screws or locking members. The viewer 1A listens to the sound (schematically shown by the solid line and dotted line arrows) reproduced by the sound bar 20.

Configuration Example of Television Apparatus

Figure 3:
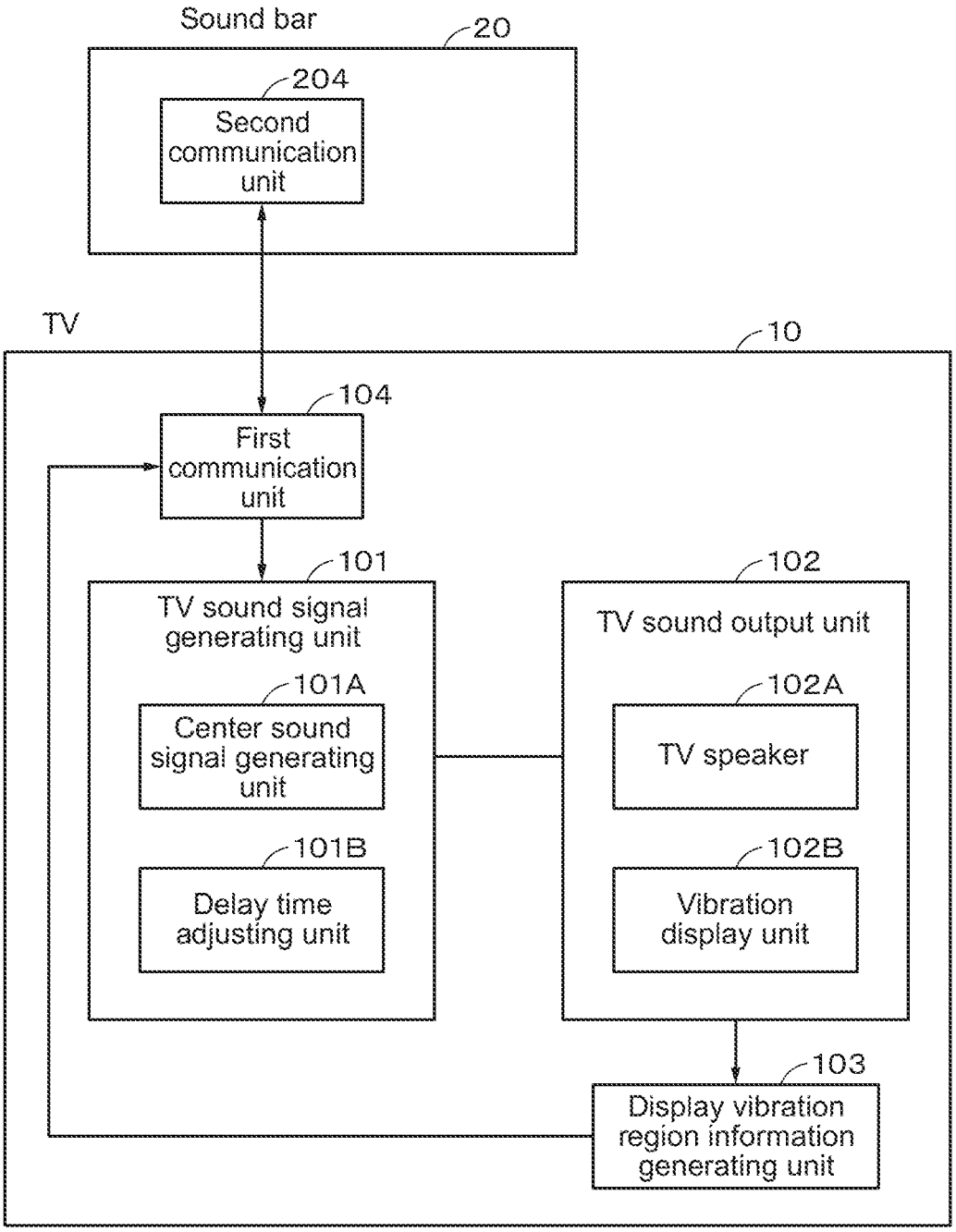
FIG. 3 is a diagram to be referred to for describing a configuration example of a television apparatus according to the embodiment.

Next, a configuration example of the television apparatus 10 will be described with reference to FIG. 3. The television apparatus 10 includes, for example, a TV sound signal generating unit 101, a TV sound output unit 102, a display vibration region information generating unit 103, and a first communication unit 104. It should be noted that although not shown in the figure, the television apparatus 10 has a well-known configuration such as a tuner.

The TV sound signal generating unit 101 generates the sound output from the television apparatus 10. The TV sound signal generating unit 101 includes a center sound signal generating unit 101A and a delay time adjusting unit 101B. The center sound signal generating unit 101A generates a signal of the center sound output from the television apparatus 10. The delay time adjusting unit 101B adjusts the delay time of the sound output from the television apparatus 10.

The TV sound output unit 102 collectively refers to a configuration for outputting the sound from the television apparatus 10. The TV sound output unit 102 according to this embodiment includes a TV speaker 102A and a vibration display unit 102B. The TV speaker 102A is a speaker provided in the television apparatus 10. The vibration display unit 102B includes a display (panel portion of a liquid crystal display (LCD), an organic light emitting diode (OLED), or the like) of the television apparatus 10, on which the video is reproduced, and an exciting part such as a piezoelectric element that vibrates the display. In this embodiment, a configuration in which the sound is reproduced by vibrating the display of the television apparatus 10 by the exciting part is employed.

The display vibration region information generating unit 103 generates display vibration region information. The display vibration region information is, for example, information indicating a vibration region that is an actually vibrating area of the display. The vibration region is, for example, a peripheral region of the exciting part set on the back surface of the display. The vibration region may be a preset region or may be a region around the exciting part during operation, which can be changed with reproduction of an audio signal. The size of the peripheral region can be set as appropriate in accordance with the size of the display or the like. The display vibration region information generated by the display vibration region information generating unit 103 is transmitted to the sound bar 20 through the first communication unit 104. It should be noted that the display vibration region information may be non-vibration region information indicating a non-vibrating region of the display.

The first communication unit 104 is configured to perform at least one of wired communication or wireless communication with the sound bar 20 and includes a modulation and demodulation circuit or the like according to the communication standards. Examples of the wireless communication include a local area network (LAN), Bluetooth (registered trademark), Wi-Fi (registered trademark), and wireless USB (WUSB). It should be noted that the sound bar 20 includes a second communication unit 204 that is a configuration that communicates with the first communication unit 104 of the television apparatus 10.

[Sound bar]

(Appearance Example of Sound Bar)

Next, the sound bar 20 will be described. First, an appearance example of the sound bar 20 will be described. The sound bar 20 has a box-like and rod-like shape, for example, and one surface thereof is a placement surface on which the speaker and the camera are disposed. As a matter of course, the shape of the sound bar 20 is not limited to the rod-like shape, and may be a thin plate shape such that it can be suspended from the wall or may be a spherical shape or the like.

Figure 4:
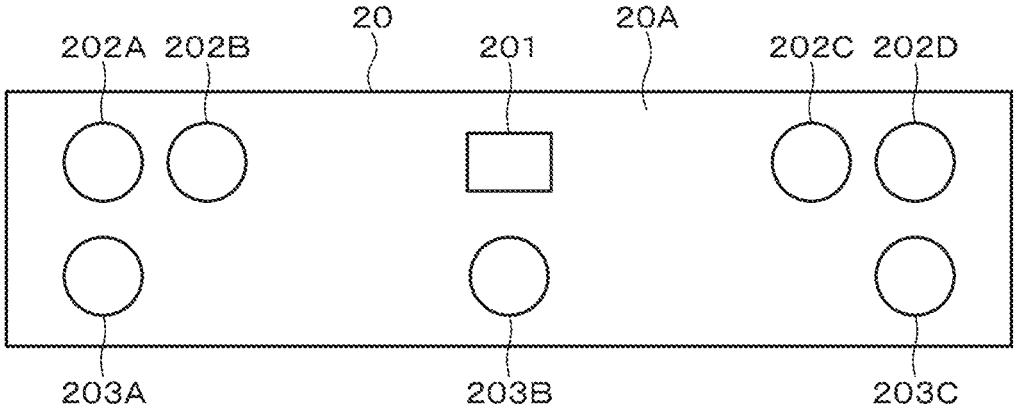
FIG. 4 is a diagram for describing a configuration example of a placement surface of a sound bar according to the embodiment.

FIG. 4 is a diagram showing an configuration example of a placement surface (surface from which sound is emitted) 20A on which the speaker of the sound bar 20 and the like and disposed. A camera 201 that is an imaging apparatus is provided near the upper center of the placement surface 20A. The camera 201 images the viewer 1A and/or the television apparatus 10.

A rear sound speaker that reproduces the rear sound is provided at each of the left and right of the camera 201. For example, two rear sound speakers (rear sound speakers 202A, 202B and rear sound speakers 202C, 202D) are provided at each of the left and right of the camera 201. It should be noted that as it is unnecessary to distinguish the individual rear sound speakers, it will be referred to as a rear sound speaker 202 as appropriate. Moreover, a front sound speaker that reproduces the front sound is provided on a lower side of the placement surface 20A. For example, three front sound speakers (front sound speakers 203A, 203B, 203C) are provided at equal intervals on the lower side of the placement surface 20A. It should be noted that as it is unnecessary to distinguish the individual front sound speaker, it will be referred to as a front sound speaker 203 as appropriate.

(Internal Configuration Example of Sound Bar)

Figure 5:
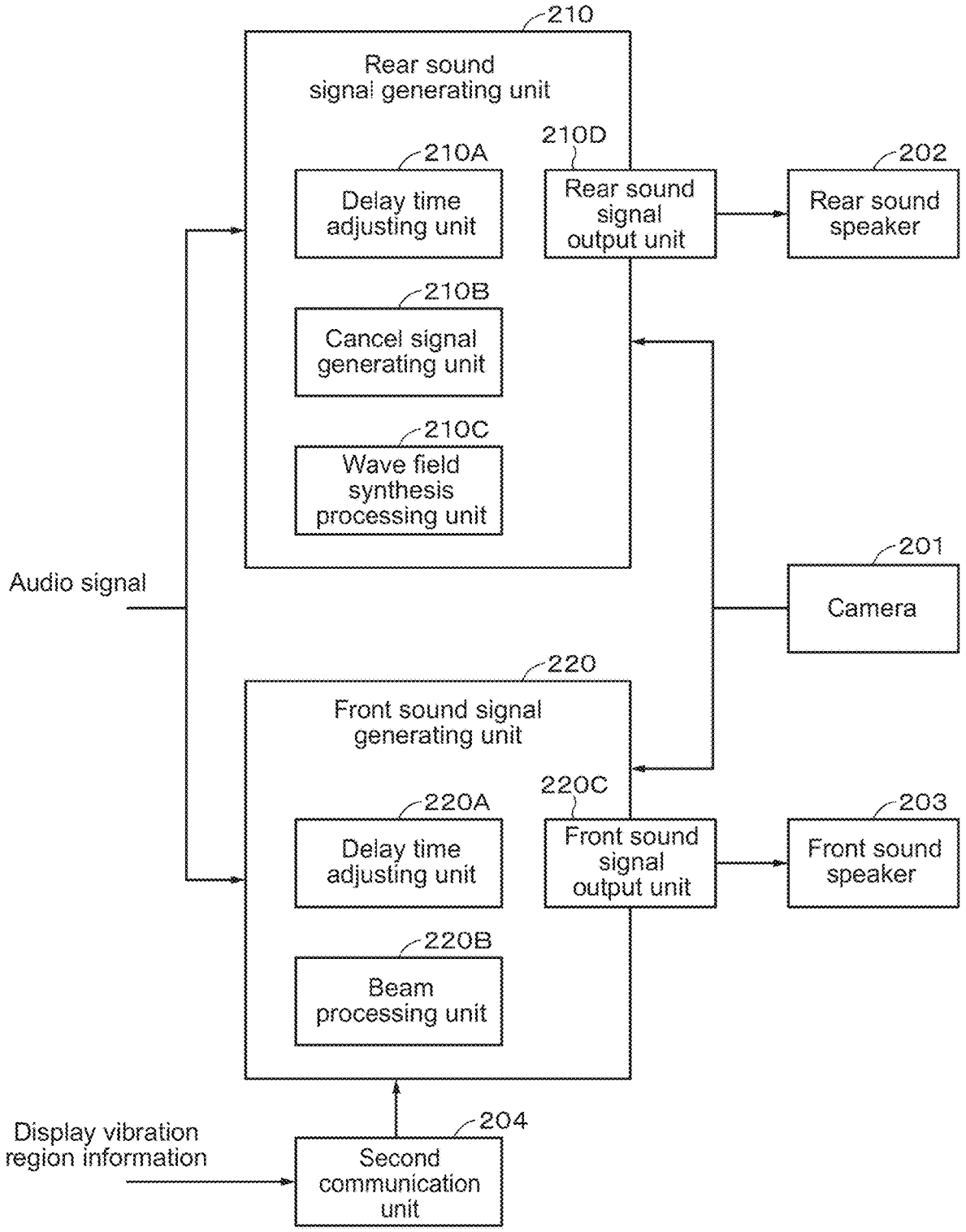
FIG. 5 is a diagram for describing an internal configuration example of the sound bar according to the embodiment.

Next, an internal configuration example of the sound bar 20 will be described with reference to FIG. 5. As described above, the sound bar 20 includes the camera 201, the rear sound speaker 202, the front sound speaker 203, and the second communication unit 204. Moreover, the sound bar 20 also includes a rear sound signal generating unit 210 that generates a rear sound on the basis of the input audio signal and a front sound signal generating unit 220 that generates a front sound on the basis of the input audio signal. The input audio signal is, for example, a sound in television broadcasting. In a case where the input audio signal is a multi-channel signal, an audio signal corresponding to a rear channel is supplied to the rear sound signal generating unit 210 and an audio signal corresponding to a front channel is supplied to the front sound signal generating unit 220. It should be noted that the rear sound or the front sound may be generated by signal processing. That is, the input audio signal is not limited to the multi-channel signal.

The rear sound signal generating unit 210 includes, for example, a delay time adjusting unit 210A, a cancel signal generating unit 210B, a wave field synthesis processing unit 210C, and a rear sound signal output unit 210D. The delay time adjusting unit 210A performs processing of adjusting the time for delaying the reproduction timing of the rear sound. The reproduction timing of the rear sound is delayed as appropriate by the processing of the delay time adjusting unit 210A. The cancel signal generating unit 210B generates a cancel signal for canceling the front sound reaching the viewer 1A directly from the sound bar 20 (with no reflections). The wave field synthesis processing unit 210C performs well-known wave field synthesis processing. The rear sound signal output unit 210D is an interface that outputs the rear sound generated by the rear sound signal generating unit 210 to the rear sound speaker 202.

It should be noted that although not shown in the figure, the rear sound signal generating unit 210 is also capable of generating a sound (surround component) that is, for example, audible from the side of the viewer 1A by performing an arithmetic operation using head-related transfer functions (HRTF) on the input audio signal. The head-related transfer function is preset on the basis of the average human head shape, for example. Alternatively, the head-related transfer functions associated with the shapes of a plurality of heads may be stored in a memory or the like, and a head-related transfer function close to the head shape of the viewer 1A imaged by the camera 201 may be read out from the memory. The read head-related transfer function may be used for the arithmetic operation of the rear sound signal generating unit 210.

The front sound signal generating unit 220 includes a delay time adjusting unit 220A, a beam processing unit 220B, and a front sound signal output unit 220C. The delay time adjusting unit 220A performs processing of adjusting the time for delaying the reproduction timing of the front sound. The reproduction timing of the front sound is delayed as appropriate by the processing of the delay time adjusting unit 220A. The beam processing unit 220B performs processing (beam processing) for the front sound reproduced from the front sound speaker 203 to have directivity in a particular direction. The front sound signal output unit 220C is an interface that outputs the front sound generated by the front sound signal generating unit 220 to the front sound speaker 203.

It should be noted that the display vibration region information received by the second communication unit 204 from the television apparatus 10 is supplied to the front sound signal generating unit 220. Moreover, a captured image acquired by the camera 201 is subjected to appropriate image processing, and is then supplied to each of the rear sound signal generating unit 210 and the front sound signal generating unit 220. For example, the rear sound signal generating unit 210 generates a rear sound on the basis of the viewer 1A and/or the television apparatus 10 imaged by the camera 201.

A configuration example of the sound bar 20 according to the embodiment has been described above. It should be noted that the configuration of the sound bar 20 can be changed as appropriate in accordance with each type of processing to be described later.

Processing Example of Reproduction System (First Processing Example)

Figure 6:
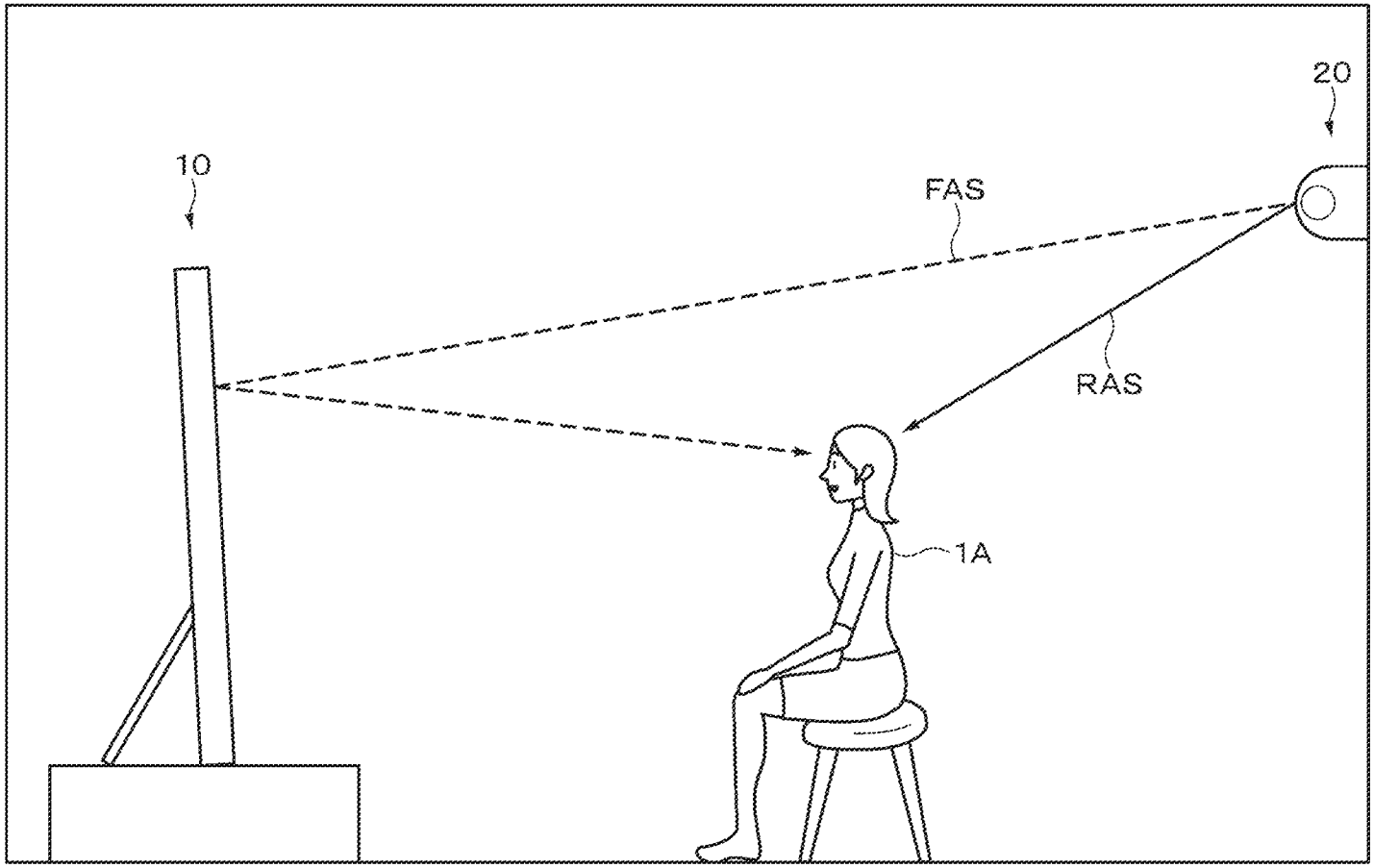
FIG. 6 is a diagram to be referred to for describing a first processing example in the embodiment.

Next, a plurality of processing examples performed by the reproduction system 5 will be described. First, a first processing example will be described with reference to FIG. 6. As shown in FIG. 6, a rear sound RAS is reproduced from the rear sound speaker 202 of the sound bar 20 toward the viewer 1A and the rear sound RAS reaches the viewer 1A directly. The rear sound RAS is reproduced toward the viewer 1A detected on the basis of the captured image captured by the camera 201, for example. Moreover, a front sound FAS is reproduced from the front sound speaker 203 of the sound bar 20. In this example, the front sound FAS is reflected on the display of the television apparatus 10 and arrives. For example, the spatial position of the display of the television apparatus 10 is determined on the basis of the captured image of the camera 201 and the beam processing unit 220B performs beam processing such that the front sound FAS has directivity to the determined spatial position.

By the way, since the rear sound RAS reaches the viewer 1A first, it is necessary to synchronize the front sound FAS with the rear sound RAS. Therefore, in this example, the delay time adjusting unit 210A performs delay processing of delaying the reproduction timing of the rear sound RAS by a predetermined time. The delay time adjusting unit 210A determines the delay time on the basis of the captured image acquired by the camera 201, for example. For example, the delay time adjusting unit 210A determines, on the basis of the captured image, each of a distance from the sound bar 20 to the viewer 1A and a distance obtained by adding a distance from the sound bar 20 to the television apparatus 10 and a distance from the television apparatus 10 to the viewer 1A and sets a delay time depending on a difference between the determined distances. It should be noted that when the viewer 1A has moved, the delay time adjusting unit 210A may calculate and set the delay time again.

In accordance with this example, the rear sound reaches directly from behind the viewer 1A. Thus, the viewer 1A can clearly perceive the position and direction of the rear sound, which it is generally difficult for the viewer 1A to perceive. On the other hand, since the front sound is reflected by the television apparatus 10, the localization feeling may be lost. However, the video is being reproduced in the television apparatus 10, and thus even when the position of the sound image is slightly shifted, the viewer 1A does not care about it because of the vision. Moreover, in accordance with this example, since the camera 201 is in a region invisible to the viewer 1A, it is possible to prevent the viewer 1A from feeling stress by thinking that the viewer 1A is being imaged. Moreover, since the sound bar 20 is disposed on the rear, it is possible to prevent the periphery of the television apparatus 10 from being unorganized with wiring.

Figure 7:
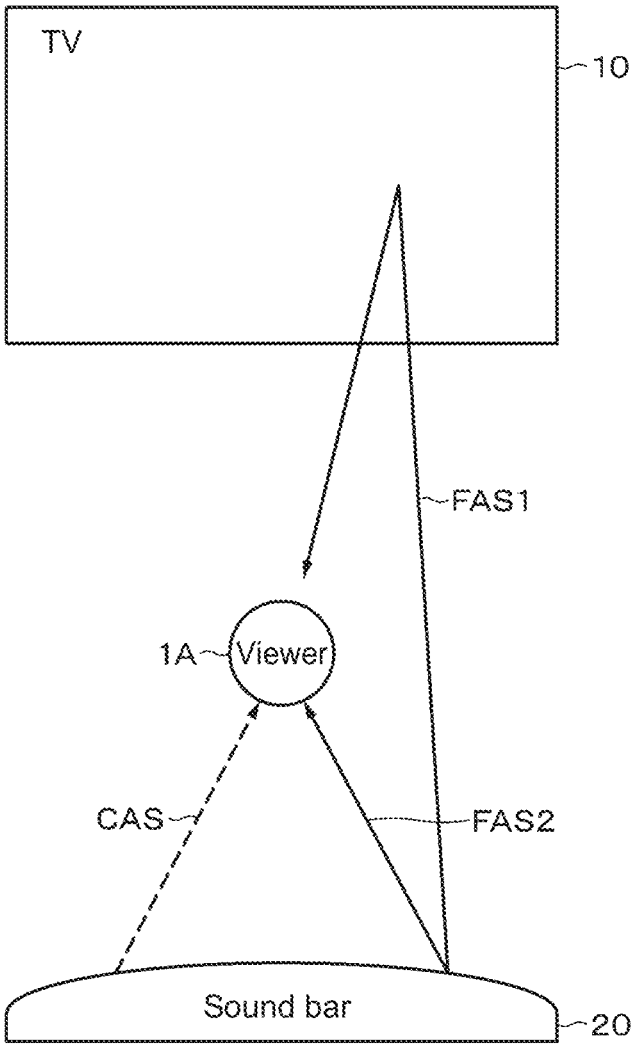
FIG. 7 is a diagram to be referred to for describing a modified example of the first processing example in the embodiment.

It should be noted that when reproducing the front sound FAS to the viewer 1A by reflecting the front sound FAS on the display of the television apparatus 10, a front sound FAS2 (direct sound) reaches the viewer 1A from the rear directly in addition to a front sound FAS1 which is reflected by the display of the television apparatus 10 and reaches the viewer 1A as shown in FIG. 7. Therefore, the front sound FAS1 may interfere with the front sound FAS2 and the sound quality may be lowered. Therefore, a cancel sound CAS that cancels the front sound FAS2 is generated by the cancel signal generating unit 210B and the generated cancel sound CAS may be reproduced. The cancel sound CAS is a signal having a phase opposite to the phase of the front sound FAS2. By reproducing the cancel sound CAS, it is possible to prevent the sound quality from being lowered due to the front sound FAS2.

(Second Processing Example)

Figure 8:
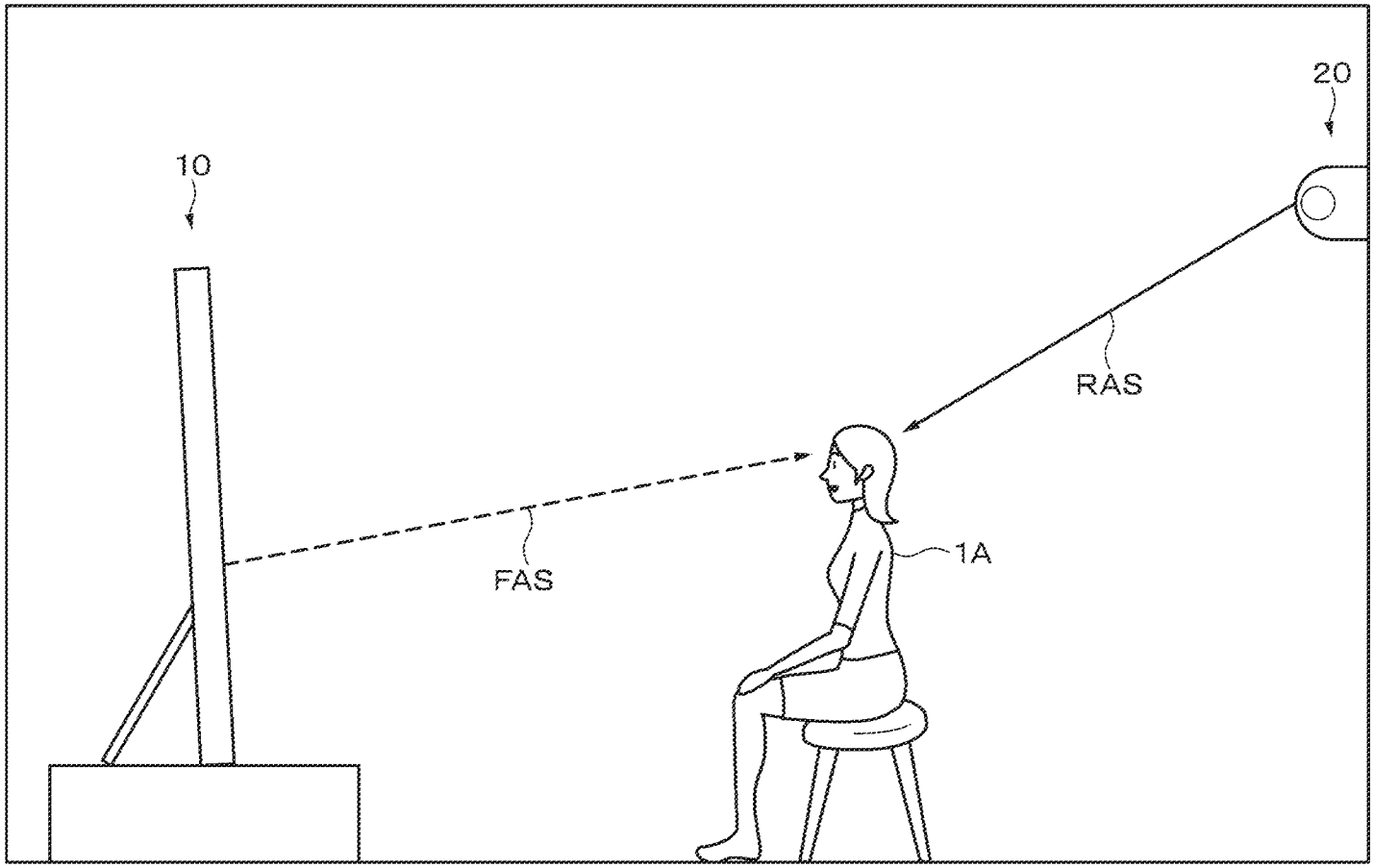
FIG. 8 is a diagram to be referred to for describing a second processing example in the embodiment.

Next, a second processing example will be described with reference to FIG. 8. The front sound FAS (e.g., center sound) is generated by the TV sound signal generating unit 101 and is reproduced from the TV speaker 102A of the TV sound output unit 102. Moreover, the rear sound RAS is generated by the rear sound signal generating unit 210 of the sound bar 20 and is reproduced from the rear sound speaker 202. It should be noted that the surround component may be generated by the sound bar 20 and the surround component may be reproduced to the viewer 1A directly or by reflection. Alternatively, for example, in a case where it is determined on the basis of the captured image acquired by the camera 201 that the distance between the television apparatus 10 and the viewer 1A is shorter than the distance between the sound bar 20 and the viewer 1A, the delay time adjusting unit 210A may perform processing of delaying the reproduction timing of the front sound FAS.

(Third Processing Example)

Figure 9:
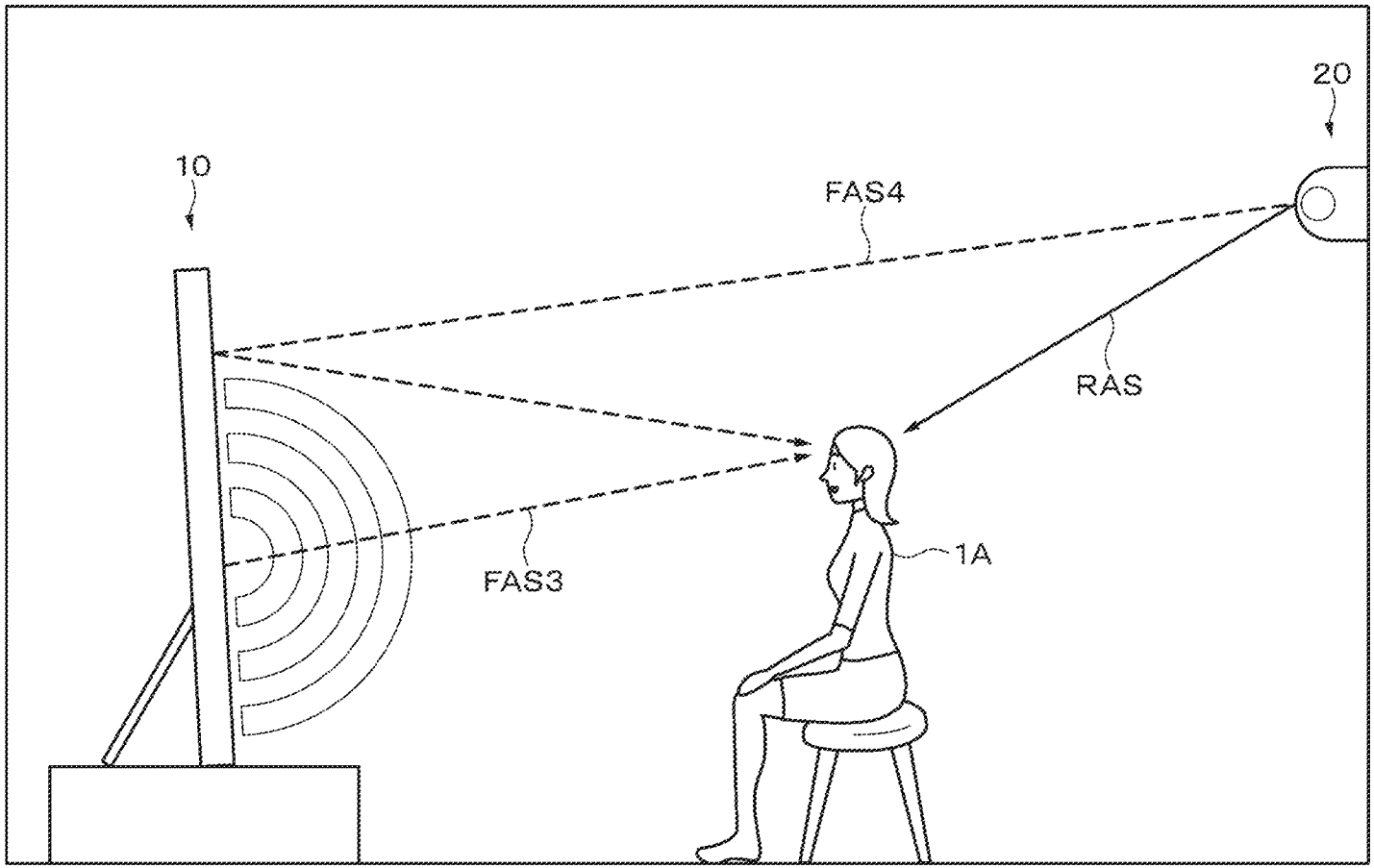
FIG. 9 is a diagram to be referred to for describing a third processing example in the embodiment.

Next, a third processing example will be described with reference to FIG. 9. As shown in FIG. 9, the rear sound RAS is generated by the rear sound signal generating unit 210 and is reproduced from the rear sound speaker 202. Moreover, a front sound FAS3 is reproduced from the television apparatus 10. In this example, the vibration display unit 102B of the television apparatus 10 operates, vibrates, such that the front sound FAS3 is reproduced. The front sound FAS3 is an element of virtual surround (e.g., center sound). Moreover, a front sound FAS4 is generated by the front sound signal generating unit 220 of the sound bar 20. The front sound FAS4 is, for example, a virtual surround element (e.g., left (L), right (R)) that differs from the front sound FAS3. The generated front sound FAS4 is reproduced from the front sound speaker 203. In this example, a configuration in which the front sound FAS4 reproduced from the front sound speaker 203 is reflected by the display of the television apparatus 10 (vibration display unit 102B) and reaches the viewer 1A is employed.

By the way, since the vibration display unit 102B is vibrating, the front sound FAS4 may be reflected to/in an undesired position or direction due to the difference between the incident angle and the output angle when the front sound FAS4 is reflected on the vibration region. Therefore, in this example, the display vibration region information received by the second communication unit 204 is supplied to the front sound signal generating unit 220. Then, on the basis of the display vibration region information, the beam processing unit 220B determines a region avoiding the vibration region, i.e., a non-vibration region which is not vibrating or is vibrating at a certain level or less and performs beam processing to adjust the directivity of the front sound FAS4 such that the front sound FAS4 is reflected on the non-vibration region. Thus, it is possible to prevent the front sound FAS4 from being reflected to/in an undesired position or direction.

It should be noted that processing of synchronizing the front sound FAS3 with the front sound FAS4 may be performed in this example. Since the front sound FAS4 has a longer sound propagation distance in the example shown in FIG. 9, the front sound FAS3 is reproduced with a delay. For example, the sound bar 20 determines a difference between the propagation distance of the front sound FAS3 and the propagation distance of the front sound FAS4 on the basis of the captured image acquired by the camera 201 and calculates a delay time on the basis of the difference. Then, the sound bar 20 transmits the calculated delay time to the television apparatus 10 via the second communication unit 204. The delay time adjusting unit 101B of the television apparatus 10 delays the reproduction timing of the front sound FAS4 by the delay time transmitted from the sound bar 20. It should be noted that in a case where it is necessary to delay the reproduction timing of the front sound FAS3, the delay time adjusting unit 220A of the front sound signal generating unit 220 delays the reproduction timing of the front sound FAS3 as appropriate.

(Fourth Processing Example)

Next, a fourth processing example will be described with reference to FIG. 10. In the fourth processing example, the sound bar 20 has a function of a projector that projects a video on a screen or the like. Well-known functions and configurations (video processing circuit and the like) for realizing the functions can be applied as the function of such a projector.

Figure 10:
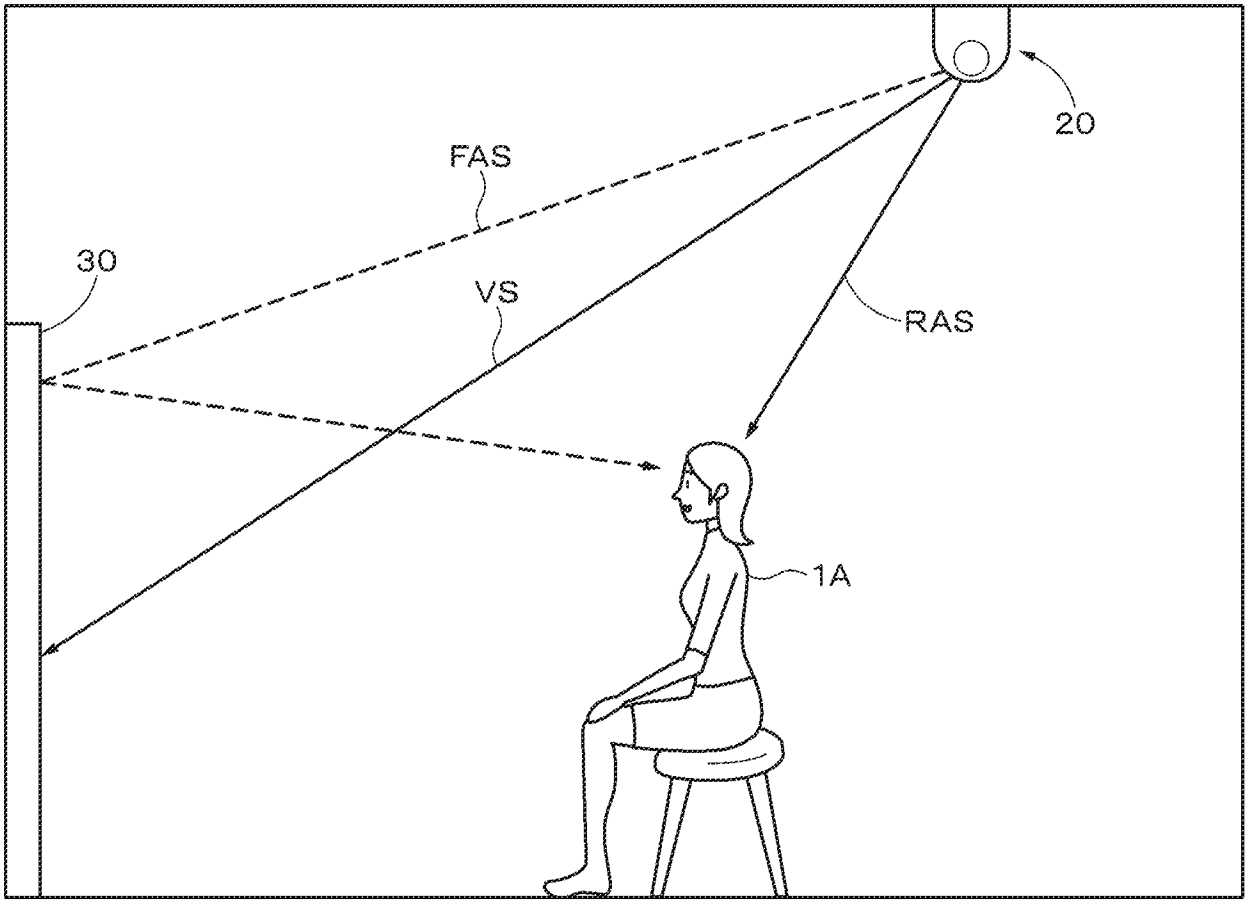
FIG. 10 is a diagram to be referred to for describing a fourth processing example in the embodiment.

As shown in FIG. 10, for example, the sound bar 20 having a projector function at a predetermined position on the ceiling (e.g., position behind the viewing position of the viewer 1A) is set. Moreover, a screen 30 is set in front of the viewer 1A. The screen 30 may be a wall. A video signal VS generated by the sound bar 20 is projected onto the screen 30 and the video is reproduced to the viewer 1A. Moreover, the rear sound RAS is generated by the rear sound signal generating unit 210 of the sound bar 20. Then, the rear sound RAS is reproduced from the rear sound speaker 202 to the viewer 1A. Moreover, the front sound FAS generated by the front sound signal generating unit 220 of the sound bar 20 is reproduced from the front sound speaker 203. In this example, a configuration in which the front sound FAS is reflected by the screen 30 and reaches the viewer 1A is employed. In accordance with this example, it is possible to save space and prevent the periphery of the screen 30 from being complicated because the configurations related to the image and sound reproduction can be integrated.

(Fifth Processing Example)

Figure 11:
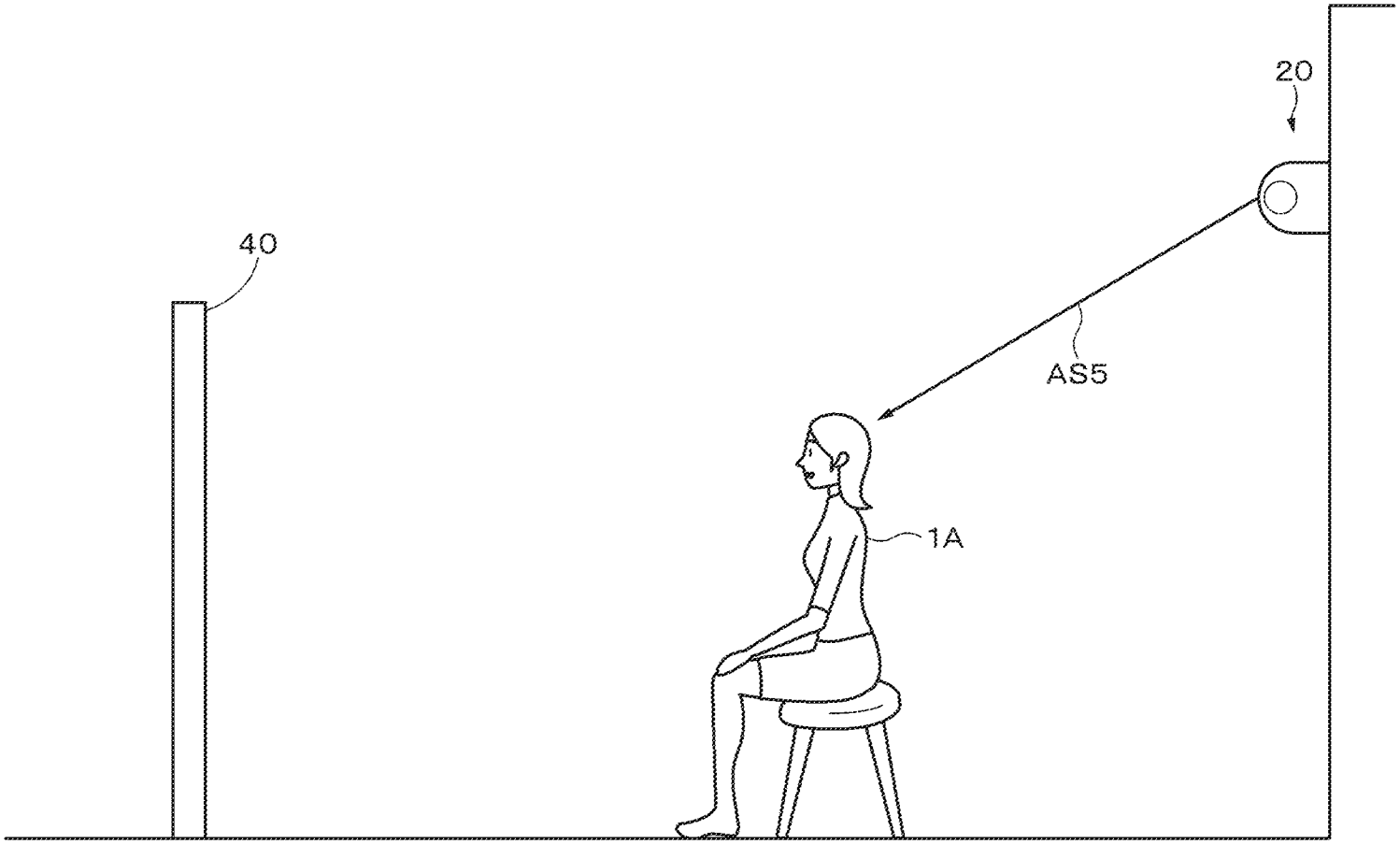
FIG. 11 is a diagram to be referred to for describing a fifth processing example in the embodiment.

Next, a fifth processing example will be described with reference to FIG. 11. A display 40 is disposed in front of the viewer 1A. A video such as an art video and an sports video is reproduced on the display 40. A high-definition display including a plurality of light emitting diode (LED) modules, which is a relatively large display (display set on a street, a playing field, or the like) is conceivable as the display 40 in this example. It is not favorable to dispose the speaker in front of the display 40 from the viewpoint of design. Therefore, a sound AS5 is reproduced from behind the viewer 1A. The sound AS5 is generated by the rear sound signal generating unit 210, for example. When the sound AS5 is generated, the wave field synthesis processing unit 210C of the rear sound signal generating unit 210 performs well-known wave field synthesis processing, to thereby provide various effects. For example, it is possible to set each of areas where English, French, or Japanese can be heard in order to describe the video reproduced on the display 40.

(Sixth Processing Example)

Figure 12:
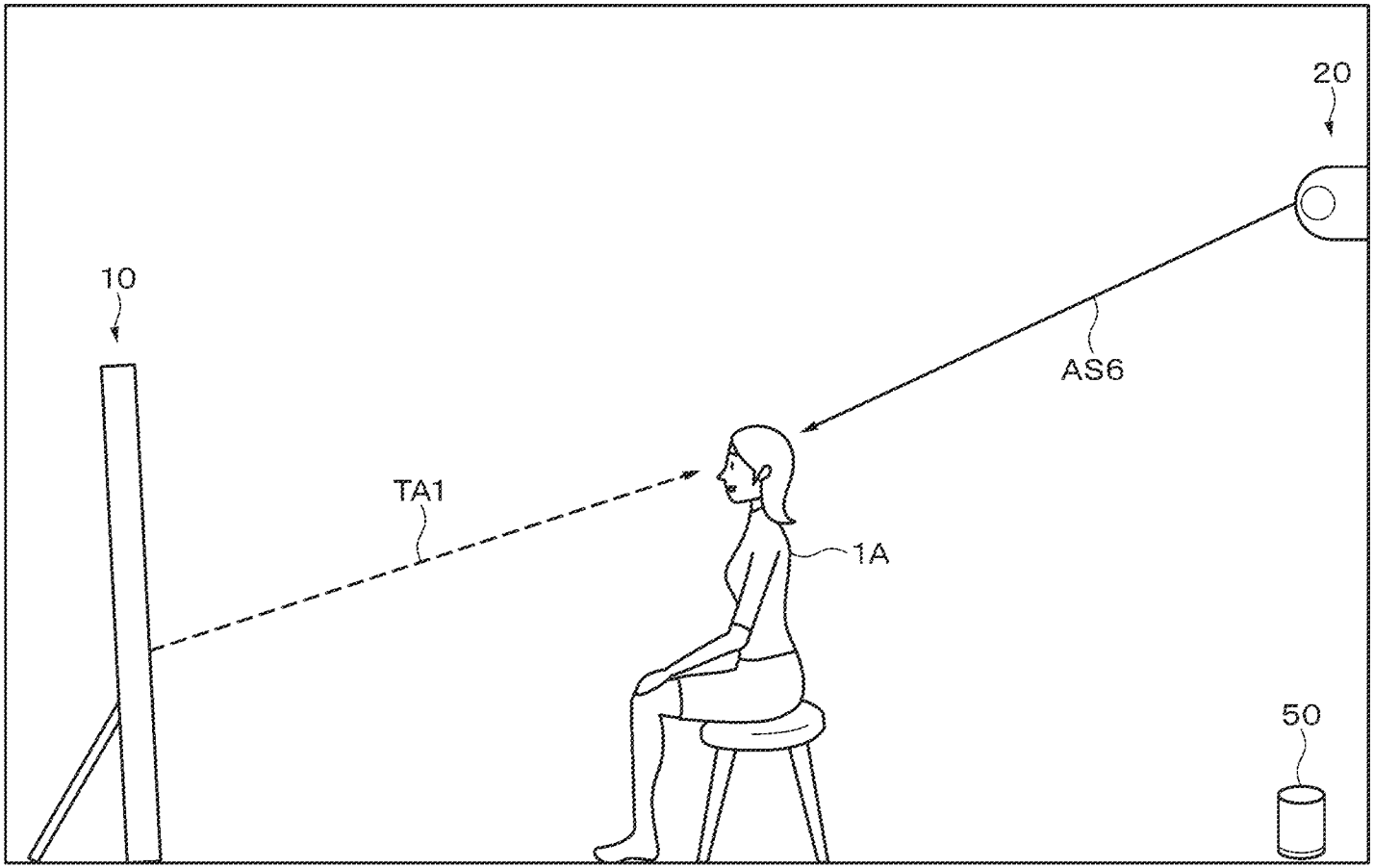
FIG. 12 is a diagram to be referred to for describing a sixth processing example in the embodiment.

Next, a sixth processing example will be described with reference to FIG. 12. As shown in FIG. 12, in this example, the television apparatus 10 is disposed in front of the viewer 1A. Moreover, the sound bar 20 is disposed on the upper rear side of the viewer 1A. Moreover, an agent apparatus 50 is disposed in the same space as the viewer 1A. The agent apparatus 50, which is also referred to as a smart speaker or the like, is an apparatus that provides various types of information to the user mainly by voice through interaction with the user (viewer 1A in this example). The agent apparatus 50 includes well-known configurations, for example, a sound processing circuit, a speaker that reproduces sound data processed by the sound processing circuit, a communication unit that connects to a server on a network or communicates with the sound bar 20, and the like.

A sound (sound TA1) of television broadcasting is reproduced from the television apparatus 10. The sound TA1 may be reproduced from the TV speaker 102A or may be reproduced by vibration of the vibration display unit 102B. Here, there is a possibility that the sound TA1 reproduced from the television apparatus 10 and the sound reproduced from the agent apparatus 50 mix together and it becomes difficult for the viewer 1A to hear them. There is also a possibility that depending on video contents of the television apparatus 10, the viewer 1A cannot know whether the sound heard by the viewer 1A is the sound TA1 of the television broadcasting or the sound reproduced by the agent apparatus 50.

In view of such a point, in this example, a sound (sound AS6) reproduced by the agent apparatus 50 is transmitted to the sound bar 20 by wireless communication, for example. Then, sound data corresponding to a sound AS6 is received by the second communication unit 204 and is reproduced using at least one of the rear sound speaker 202 or the front sound speaker 203. That is, in this example, the sound AS6 originally reproduced by the agent apparatus 50 is reproduced by the sound bar 20, not by the agent apparatus 50. It should be noted that the rear sound signal generating unit 210 of the sound bar 20 may perform an arithmetic operation using the head-related transfer function on the sound data such that the sound AS6 is reproduced in the ear of the viewer 1A. Alternatively, the front sound signal generating unit 220 may perform beam processing on the sound data such that the sound AS6 is reproduced in the ear of the viewer 1A. Thus, it is possible for the viewer 1A to distinguish between the sound TA1 of the television broadcasting and the sound AS6. Moreover, for example, even in a case where a plurality of persons (e.g., viewers of the television apparatus 10) are present, a mail ring tone or the like may be reproduced only to the person (target person) to notify of the incoming mail.

It should be noted that the television apparatus 10 in this example may be a TV with an agent function which is integrated with the agent apparatus 50. The sound data corresponding to the sound AS6 is transmitted from the TV with the agent function to the sound bar 20, a television sound is reproduced from the TV with the agent function, and the sound AS6 based on the agent function is reproduced from the sound bar 20. Thus, even in a case where the television apparatus 10 has the agent function, the sound based on the agent function can be reproduced from the sound bar 20 without interrupting the reproduction of the television sound.

Modified Examples

While the embodiment of the present disclosure has been specifically described above, the details of the present disclosure are not limited to the above-mentioned embodiment, and various modifications based on the technical idea of the present disclosure can be made.

In the above-mentioned embodiment, the audio signal input to the sound bar may be so-called object-based audio in which a sound for each object is defined and the sound movement is clearer. For example, it is possible to reproduce a sound following the viewer's movement by tracking the viewer's position with a sound bar camera and reproducing a predetermined object sound at a peripheral position corresponding to the viewer's position.

The sound bar is not limited to a projector and may be integrated with an air conditioner or light. Moreover, the display is not limited to the display or screen of the television apparatus and may be an eye-glasses-type display or a head up display (HUD).

In the above-mentioned embodiment, the front sound may be made to reach the viewer directly from the sound bar without reflection on the display of the television apparatus. For example, the front sound signal generating unit 220 generates a sound that goes around the side of the viewer to the front by subjecting the sound data to an arithmetic operation using a predetermined head-related transfer function according to the viewer's head shape. By reproducing the sound, the front sound can directly reach the viewer from the sound bar.

Each of the processing examples in the above-mentioned embodiment may be performed in combination. The configurations of the sound bar and the television apparatus can be changed as appropriate in accordance with the type of processing performed by each apparatus. For example, the rear sound signal generating unit may include the beam processing unit. Moreover, the viewer does not necessarily have to sit and the present disclosure can be applied to a case where the viewer stands and moves.

The present disclosure can also be implemented as an apparatus, a method, a program, a system, and the like. For example, a program for performing the functions described in the above embodiment is made downloadable, and an apparatus not having the functions described in the embodiment can perform the control described in the embodiment in the apparatus by downloading and installing the program. The present disclosure can also be realized by a server that distributes such a program. Moreover, the matters described in the respective embodiment and modified examples can be combined as appropriate. Moreover, the details of the present disclosure are not to be construed as being limited by the effects illustrated in the present specification.

The present disclosure can also take the following configurations.

(1) A sound bar, including:

a rear sound signal generating unit that generates a rear sound from an input audio signal; and an output unit that outputs the rear sound generated by the rear sound signal generating unit to a rear sound speaker.

(2) The sound bar according to (1), in which the rear sound signal generating unit includes a delay time adjusting unit that adjusts a time for delaying a reproduction timing of the rear sound.

(3) The sound bar according to (1) or (2), in which the rear sound signal generating unit generates the rear sound subjected to an arithmetic operation based on a head-related transfer function.

(4) The sound bar according to (3), in which the head-related transfer function is determined on the basis of a captured image of a viewer.

(5) The sound bar according to any of (1) to (3), in which the rear sound signal generating unit generates the rear sound subjected to wave field synthesis processing.

(6) The sound bar according to any of (1) to (5), further including a front sound signal generating unit that generates a front sound on the basis of the input audio signal.

(7) The sound bar according to (6), in which the front sound signal generating unit includes a delay time adjusting unit that adjusts a time for delaying a reproduction timing of the front sound.

(8) The sound bar according to (6) or (7), in which the front sound signal generating unit generates the front sound subjected to an arithmetic operation based on a head-related transfer function.

(9) The sound bar according to any of (6) to (8), in which the front sound signal generating unit generates the front sound to be reflected by a display of a television apparatus.

(10) The sound bar according to (9), further including a cancel signal generating unit that generates a cancel signal having a phase opposite to a phase of the front sound of the front sound signal generating unit.

(11) The sound bar according to (9) or (10), in which the front sound signal generating unit generates front sound to be reflected on a non-vibration region of the display.

(12) The sound bar according to (11), in which the non-vibration region is determined on the basis of information sent from the television apparatus.

(13) The sound bar according to any of (9) to (11), further including an imaging apparatus that images a viewer and/or the television apparatus.

(14) The sound bar according to (13), in which the rear sound signal generating unit generates the rear sound on the basis of the viewer and/or the television apparatus imaged by the imaging apparatus.

(15) An audio signal processing method in a sound bar, including:

generating, by a rear sound signal generating unit, a rear sound from an input audio signal; and outputting, by an output unit, the rear sound generated by the rear sound signal generating unit to a rear sound speaker.

(16) A program that causes a computer to perform an audio signal processing method in a sound bar:

generating, by a rear sound signal generating unit, a rear sound from an input audio signal; and outputting, by an output unit, the rear sound generated by the rear sound signal generating unit to a rear sound speaker.

REFERENCE SIGNS LIST

10 television apparatus
20 sound bar
201 camera
202 rear sound speaker
203 front sound speaker
204 second communication unit
210 rear sound signal generating unit
210A delay time adjusting unit
210B cancel signal generating unit
210C wave field synthesis processing unit
210D rear sound signal output unit
220 front sound signal generating unit
220A delay time adjusting unit
220B beam processing unit
220C front sound signal output unit

The invention claimed is:

1. A sound bar, comprising:

circuitry configured to:

generate a rear sound from an input audio signal;

output the rear sound to a rear sound speaker; and generate a front sound on a basis of the input audio signal, wherein the front sound is generated to be reflected by a non-vibration region of a display of a television apparatus and wherein the non-vibration region is determined on a basis of information sent from the television apparatus.

2. The sound bar according to claim 1, wherein the circuitry is configured to adjust a time for delaying a reproduction timing of the rear sound.

3. The sound bar according to claim 1, wherein the circuitry is configured to generate the rear sound subjected to an arithmetic operation based on a head-related transfer function.

4. The sound bar according to claim 3, wherein the head-related transfer function is determined on a basis of a captured image of a viewer.

5. The sound bar according to claim 1, wherein the circuitry is configured to generate the rear sound subjected to wave field synthesis processing.

6. The sound bar according to claim 1, wherein the circuitry is configured to adjust a time for delaying a reproduction timing of the front sound.

7. The sound bar according to claim 1, wherein the circuitry is configured to generate the front sound subjected to an arithmetic operation based on a head-related transfer function.

8. The sound bar according to claim 1, wherein the circuitry is further configured to generate a cancel signal having a phase opposite to a phase of the front sound.

9. The sound bar according to claim 1, further comprising an imaging apparatus configured to image a viewer and/or the television apparatus.

10. The sound bar according to claim 9, wherein the circuitry is configured to generate the rear sound on a basis of the viewer and/or the television apparatus imaged by the imaging apparatus.

11. An audio signal processing method executed by circuitry in a sound bar, the method comprising:

generating a rear sound from an input audio signal;

outputting the rear sound to a rear sound speaker; and generating a front sound on a basis of the input audio signal, wherein the front sound is generated to be reflected by a non-vibration region of a display of a television apparatus and wherein the non-vibration region is determined on a basis of information sent from the television apparatus.

12. A non-transitory computer readable medium storing instructions that, when executed by circuitry in a sound bar, perform an audio signal processing method comprising:

generating a rear sound from an input audio signal;

outputting the rear sound to a rear sound speaker; and generating a front sound on a basis of the input audio signal, wherein the front sound is generated to be reflected by a non-vibration region of a display of a television apparatus and wherein the non-vibration region is determined on a basis of information sent from the television apparatus.

* * * * *